United States Patent [19]

Konaka

[11] Patent Number: 4,871,348

[45] Date of Patent: Oct. 3, 1989

[54] CARTON ERECTING APPARATUS

[75] Inventor: Yukio Konaka, Kanazawa, Japan

[73] Assignee: Shibuya Kogyo Co. Ltd., Ishikawa, Japan

[21] Appl. No.: 73,814

[22] Filed: Jul. 15, 1987

[30] Foreign Application Priority Data

Dec. 29, 1986 [JP] Japan ..... 62-303161

[51] Int. Cl.[4] ..... B31B 5/78; B31B 5/80

[52] U.S. Cl. ..... 493/315; 493/317

[58] Field of Search ..... 493/315, 317, 319; 271/91, 95, 99; 414/128, 129, 330

[56] References Cited

U.S. PATENT DOCUMENTS

| | | | |
|---|---|---|---|
| 2,936,681 | 5/1960 | Earp | 493/315 |
| 3,016,808 | 1/1962 | Galloway | 271/91 |
| 3,527,367 | 9/1970 | Bivans | 414/330 |
| 3,599,541 | 8/1971 | Allen | 493/315 |
| 3,858,490 | 1/1975 | Heisler | 493/316 |
| 4,194,442 | 3/1980 | Martelli | 493/316 |
| 4,348,853 | 9/1982 | Morse et al. | 493/316 |
| 4,518,301 | 5/1985 | Greenwell | 414/129 |
| 4,531,931 | 7/1985 | Dietrich | 493/317 |
| 4,605,393 | 8/1986 | Krieger et al. | 493/317 |
| 4,613,525 | 10/1971 | Lense | 493/315 |
| 4,629,446 | 12/1986 | Focke | 493/317 |

FOREIGN PATENT DOCUMENTS

| | | | |
|---|---|---|---|
| 3207902 | 9/1983 | Fed. Rep. of Germany . | |
| 004524 | 10/1981 | Japan . | |
| 61-41811 | 9/1986 | Japan . | |
| 232130 | 10/1986 | Japan . | |
| 302338 | 12/1954 | Switzerland | 493/317 |

*Primary Examiner*—Frederick R. Schmidt
*Assistant Examiner*—William E. Terrell
*Attorney, Agent, or Firm*—Flynn, Thiel, Boutell & Tanis

[57] ABSTRACT

A carton delivery apparatus is disclosed which removes cartons, one by one, which are already scored and stored in a stack in a magazine, as folded down flat against each other. A suction mechanism removes cartons one by one from the magazine by holding it attracted thereto and delivers it to a conveyer. The suction mechanism is mounted on a rotatable member which is rotatable about a horizontal shaft disposed between the magazine and the conveyer. The suction mechanism is also rockable about a support shaft which is mounted on the member so that as the member rotates, the suction mechanism removes a carton and deliver it to the conveyer while holding it attracted thereto on its lower side.

11 Claims, 4 Drawing Sheets

CARTON ERECTING APPARATUS

BACKGROUND OF THE INVENTION

The invention relates to a carton delivery apparatus which removes cartons, which are already scored and stored in a stack in a magazine as folded down flat against each other, one by one and delivers them to a conveyer.

A plurality of cartons, which are already scored and folded down flat, may be stored in a stack in a magazine, and a carton delivery apparatus may be used to remove them, one by one, by utilizing a vacuum suction mechanism and to deliver them onto a conveyor. These cartons are erected into a box configuration while they are being transferred by the suction mechanism or while they are on the conveyer for containment of a content therein.

A conventional carton delivery apparatus takes out the cartons generally through a reciprocatory motion, which however inhabits a removal of cartons at a high speed and in a stable manner. Accordingly, a variety of carton delivery apparatus of rotary type which enables a high speed delivery are proposed (see Japanese Laid-Open Patent Application No. 4,524/1981 or corresponding West German counterpart No. P 2923909.6, Japanese Laid-Open Patent Application No. 232,130/1986 and Japanese Patent Publication No. 41,811/1986 or its counterpart U.S. Pat. No. 4,194,442. In either instance, the prior art apparatus is arranged with an upwardly located magazine, from which the suction mechanism removes a carton and then rotates to deliver it to a conveyer which is disposed below the apparatus while the suction mechanism continues to hold the carton from the upside. Accordingly, when a particular carton delivery apparatus is to operate with cartons of varying sizes, the spacing between the sucker surface of the suction mechanism and the level of the conveyer must be adjusted, which is disadvantageous.

SUMMARY OF THE INVENTION

Accordingly, it is an object of the invention to provide a carton delivery apparatus of rotary type which avoids the need for an adjustment when used with cartons of varying sizes. The above object is accomplished in accordance with the invention by providing a suction mechanism which takes out cartons, which are already scored and stored in a stack in a magazine as folded down flat against each other, one by one by suction and delivers it to a conveyer which is located below the magazine. In accordance with the invention, the suction mechanism is mounted on a rotatable member which is rotatable about a horizontal shaft disposed intermediate the magazine and the conveyer so as to be integrally rotatable therewith. In addition, the suction mechanism is rockable about a support shaft which is fastened to the rotatable member so that during the rotation of the rotatable member, the suction mechanism is able to take out a carton and to delivery it to the conveyer while holding it attracted thereto on its lower surface.

DESCRIPTION OF EMBODIMENT

Figure 1:
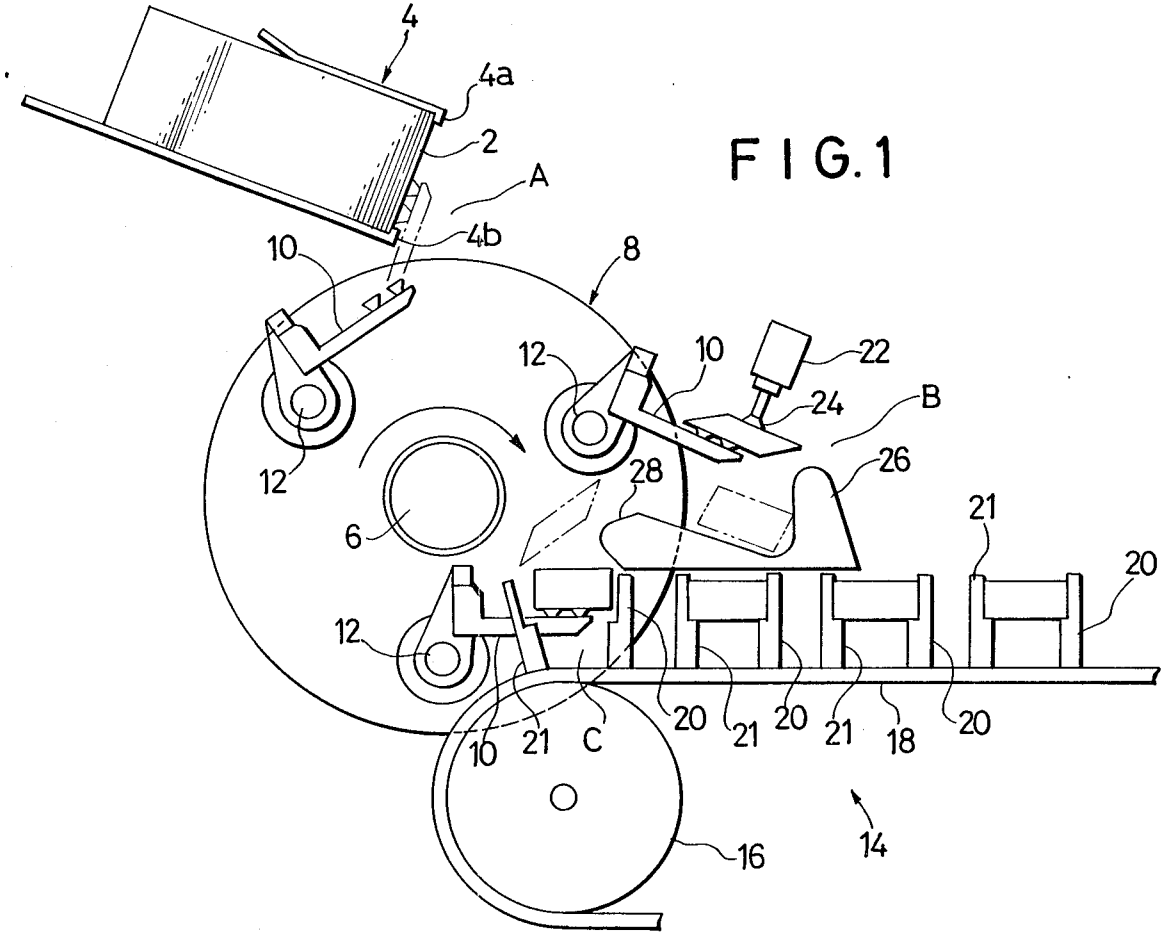
FIG. 1 is a schematic side elevation of a carton delivery apparatus according to one embodiment of the invention.

Referring to the drawings, and embodiment of the invention will be described. FIG. 1 is a schematic side elevation of a carton delivery apparatus according to one embodiment of the invention. Specifically, a plurality of cartons 2 which are already scored are stored in a stack in a magazine 4 as folded down flat against each other. The magazine 4 is disposed at an angle with respect to the horizontal, and has a wide opening at its front side or right end, as viewed in FIG. 1, where upper and lower pawls 4*a* and 4*b* are adopted to engage the endmost carton 2 to hold it in place.

Disposed below the magazine 4 is a stationary horizontal shaft 6, around which a rotatable member 8 is disposed in a rotatable manner. The rotatable member 8 carries three suction mechanisms 10 which are spaced apart circumferentially at an equal interval. Each suction mechanism 10 is mounted on the member 8 by means of rotatable support shaft 12, whereby the suction mechanism is rotatable together with the member 8 and is also rockable about the support shaft 12.

Disposed below the member 8 is a conveyer 14 which conveys the cartons 2 as they are removed and erected by the suction mechanism 10. The conveyer 14 includes a chain belt 18 extending between a sprocket 16 and another sprocket, not shown, and a plurality of respectively laterally spaced sets of front feed pawls 20, and rear feed pawls 21 which are fixedly mounted at a given spacing along the length of the chain belt 18.

The cartons 2 which are already scored and contained within the magazine 4 are taken out therefrom at a stage A by being attracted by the suction mechanism 10, then subjected to a preliminary erection at a stage B where the sucker 24 of a suction unit 22 applies suction to one of the cartons from its upside, followed by an interference with a folding guide 26 to facilitate feeding the air into its interior for subsequent opening, and finally further expanded by an erecting guide 28 at a stage C to be delivered to the conveyer 14 on which it is conveyed while maintained in its box-shaped configuration between the set of feed pawls 20, 21.

Figure 2:
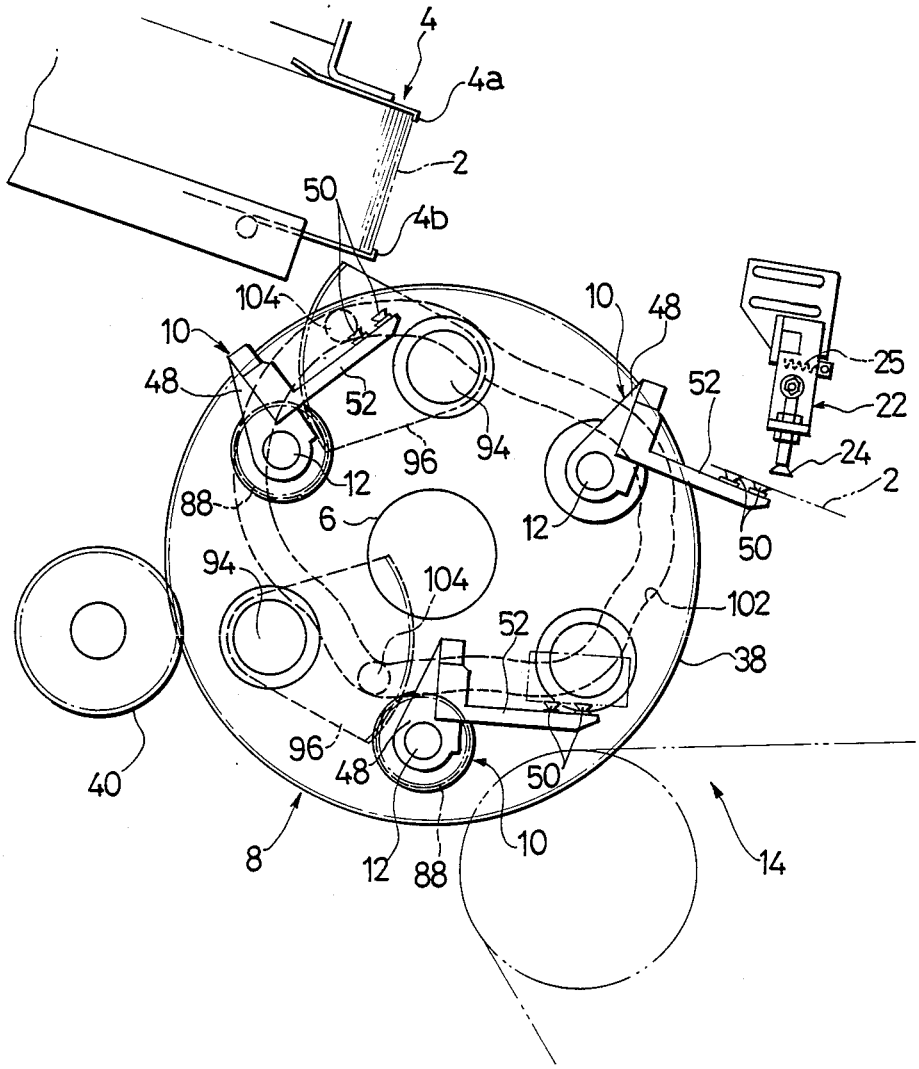
FIG. 2 is a front view of the apparatus.
Figure 3:
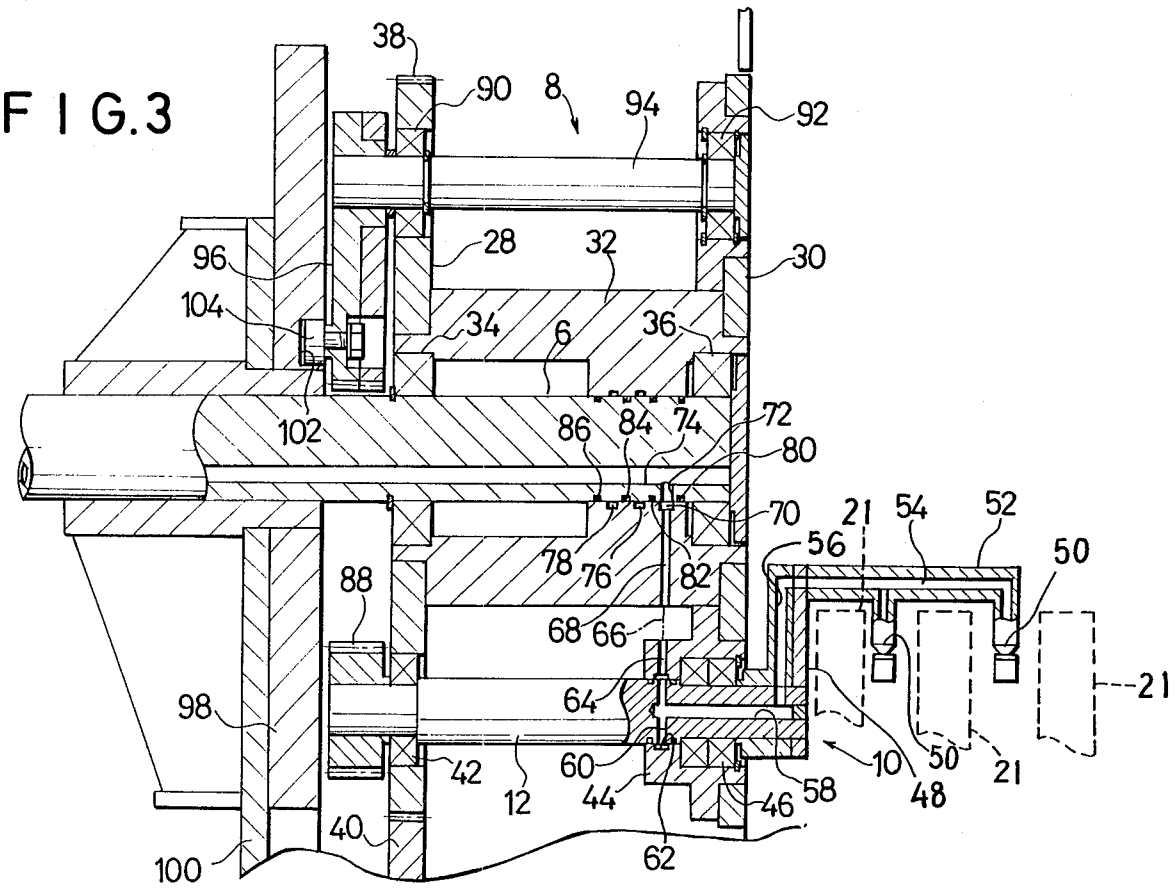
FIG. 3 is a longitudinal section of the apparatus.
Figure 4:
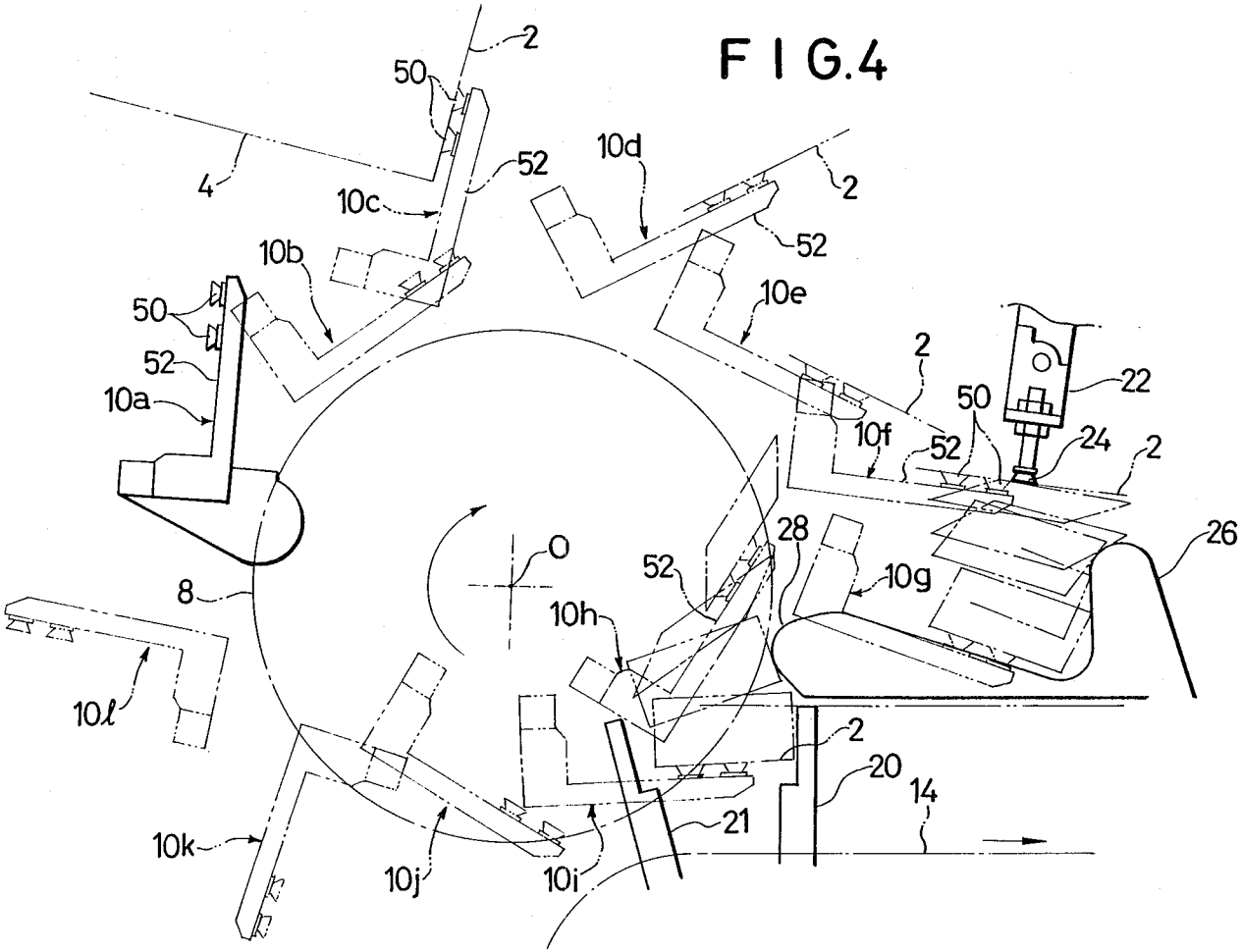
FIG. 4 is an illustration of successive phases of operation.

Referring to FIGS. 2 to 4, the above arrangement will be described in further detail. FIG. 2 is a front view of the apparatus and FIG. 3 is a longitudinal section through the apparatus shown in FIG. 2. The rotatable member 8 comprises a pair of discs 28, 30 which are coupled together by a cylindrical body 32 extending therebetween and is rotatably supported on the horizontal stationary shaft 6 by means of bearings 34, 36. A gear 38 is formed around the periphery of the disc 28 of the rotatable member 8 and is in meshing engagement with a drive gear 40 for rotation. The support shaft 12 of each suction mechanism 10 is rotatably mounted on the rotatable member 8 by a bearing 42 disposed within the opening of the disc 28, and another bearing 46 disposed inside an annular body 44 which is secured to the other disc 30. On its end projecting beyond the annular body 44, the support shaft 12 fixedly carries a carton positioning structure which includes a lever 48 having a rockable end on which an arm 52 carrying a sucker 50 is fixedly mounted. The arm 52 extends away from the rotatable member 8 and has an L-shaped part (FIG. 2), spaced from the member 8 and the lever 48, which carries the sucker 50. The sucker 50 communicates with an annular groove 62 formed in the internal surface of the annular body 44 through an internal passage 54 extending through the arm 52, an internal passage 56 through the lever 48 and an axial passage 58 and a radial passage 60 both formed in the support shaft 12. The annular groove 62 in the annular body 44 communicates with an annular groove 70 formed in the internal surface of the cylindrical body 32 through a passage 64, a tube 66 and a passage 68 extending through the cylindrical body 32, and thence connected to a vacuum source, not shown, through a passage 72 and an axial passage 74 formed in the stationary shaft 6. Three suction mechanisms 10 carried by the rotatable member 8 are connected to a vacuum source, respectively, through three different annular grooves 70, 76 and 78 which are formed in the cylindrical body 32 to permit the vacuum to be applied and disconnected independently. O-rings 80, 82, 84 and 86 are fixedly fitted in the interface between the external surface of the cylindrical body 32 at locations on the opposite sides of the respective annular grooves, 70, 76 and 78 to enable the cylindrical body 32 to slide while maintaining its hermetic seal around the stationary shaft 6. One end of each support shaft 12 projects beyond the disc 28, where it carries a gear 88. The suction mechanism 10 is driven for rocking motion through the gear 88.

Three rotary shafts 94 are disposed at locations intermediate the three support shafts 12 and are rotatably carried by bearings 90, 92. The rotary shaft 94 has an end which projects beyond the disc 98, on which a sector gear 96 is fixedly mounted for meshing engagement with the gear 88. It is to be noted that in FIG. 2, one of the sector gears 96 is omitted from illustration. A cam plate 98 is fixedly mounted on a frame 100 of the apparatus at a location adjacent to the gear 88 and the sector gear 96 which are disposed beyond the disc 28. The cam plate 98 is formed with a groove cam 102 which is profiled as shown in FIG. 2, and which is engaged by a cam follower 104 which is mounted on the sector gear 96 adjacent to its outer periphery. Consequently, as the rotatable member 8 rotates, the cam follower 104 on the sector gear 96 moves along the groove cam 102, causing the sector gear 96 to rock about the rotary shaft 94 while itself continuing to rotate around the stationary shaft 6. The resulting rocking motion of the sector gear 96 is transmitted through the gear 88 to the support shaft 12, which in turn results in a rocking motion of the lever 48 and the arm 52 as the support shaft 12 rotates.

FIG. 4 illustrates a trajectory of a rocking motion of the suction mechanism 10 contemporary with its rotation as a result of the action of the groove cam 102 which is profiled in the manner mentioned above. The operation of the carton delivery apparatus will be described with reference to this Figure. As the member 8 rotates clockwise, one of the suction mechanisms, 10*a*, which is located below the magazine 4 will have its free end of the arm 52, on which the sucker 50 is mounted, rocked toward the center 0 of the member 8 to avoid interference with the magazine 4 as the mechanism moves close to the magazine 4, whereupon the free end of the arm 52 will be quickly oscillated in the outward direction to bring its sucker 50 into contact with one of the cartons 2 which are contained within the magazine 4, as illustrated in 10*c*. At this point, the sucker 50 is connected to the vacuum source to hold the carton 2 attracted thereto (stage A shown in FIG. 1). Subsequently, which the suction mechanism 10 continues its rotation, the free end of the arm 52 is slightly oscillated in the inward direction to take the carton 2 out of the magazine 4, as illustrated at 10*d*. During a further rotation (10*e*), the free end of the arm 52 is rocked outwardly from its position where it is located close to the suction unit 22, whereby the opposite surface of the carton 2 from that which is held attracted by the sucker 50 of the suction mechanism 10 is brought into contact with and held attracted by the sucker 24 of the suction unit 22, as shown at 10*f*. It is to be noted that the sucker 24 of the suction unit 22 is supported by a spring 25 in a manner to enable a movement thereof while maintaining its axis perpendicular to the carton 2 during the time the carton 2 is held attracted thereby while the sucker 24 is maintained at a location where the attracting operation upon the carton 2 can be initiated when no carton is held attracted thereto. As the rotation continues and after the both suckers 50 and 54 are separated to expand the carton 2 to a small degree, the supply of the vacuum to the suction unit 22 is interrupted for a brief interval, allowing the carton 2 to interfere with the folding guide 26 for purpose of preliminary erection, as illustrated at 10*g* (stage B shown in FIG. 1), while the carton moves down as its lower side is held attracted by the suction mechanism 10. Subsequently, the free end of the arm 52 of the carton positioning structure is quickly oscillated inward, as shown at 10*h*, followed by a rocking movement in the outward direction, whereby the carton 2 bears against the erecting guide 28 to be expanded, to a greater degree and then delivered to the lateral space defined between each pair of feed pawls 20, 21 on the running conveyer 14 which is located therebelow, as shown at 10*i* (stage C of FIG. 1) and in broken lines in FIG. 3. At 10*i*, the rotation of the member 8, together with the rocking or rotation of the suction mechanism 10, results in vertical movement of the carton 2 downward into the space defined by the feed pawls 20, 21. At the time the carton is delivered to the conveyer 14, the sucker 50 is disconnected from the vacuum source to free the carton 2. After freeing the carton 2, the suction mechanism 10 rocks outward while continuing its rotation, as indicated by a series of successive locations 10*j*, 10*k* and 10*l*, thus moving toward the magazine 4 in preparation to removing another one of the cartons 2, as shown at 10*a*. As a result of the three suction mechanisms 10, located at different positions, repeating the described operation in a sequential manner, the cartons 2 which are contained within the magazine 4 are successively erected and delivered to the conveyer 14 for purpose of conveying.

In the described embodiment, the carton 2 is delivered to the conveyer 14 while its lower side is held attracted. Accordingly, if the erected carton 2 has a different height, there is no need to adjust the location of the suction mechanism 10 or the elevation of the conveyer 14, and thus the apparatus can be universally used with varying sizes of the carton.

It is to be understood that the number of the suction mechanisms 10 is not limited to three nor is the number of the sucker 50. The profile of the groove cam 102 is not limited to the one illustrated.

While the invention has been illustrated and described above in connection with an embodiment thereof, it should be understood that a number of changes, modifications and substitutions will readily occur to one skilled in the art from the above disclosure without departing from the spirit and scope of the invention as defined by the appended claims.

What is claimed is:

1. An apparatus for erecting cartons, comprising:

a magazine having collapsed cartons stored therein, an outlet opening on said magazine from which stored cartons can be removed, an elongated conveyor having at least one sprocket means rotatable about a first axis of rotation, and a conveyor element guided by said sprocket means, said conveyor element having conveying means thereon oriented a finite distance from said outlet opening on said magazine and adapted to support an opened carton thereon, a primary shaft having a second axis of rotation oriented between said outlet opening on said magazine and said conveying means and parallel to said first axis of rotation, a rotatable member continuously rotatable about said second axis of rotation of said primary shaft, a plurality of circumferentially spaced suction mechanisms mounted on said rotatable member and rotatable therewith, plural support means for supporting each of said suction mechanisms for rotation relative to said rotatable member and about axes remote from and parallel to said second axis of rotation of said primary shaft, said suction mechanisms having suction means for releasably gripping said collapsed cartons at said outlet opening on an attachment side thereof, and carton manipulating means for effecting a movement of said suction mechanisms relative to said rotatable member to remove said collapsed cartons from said magazine, open said collapsed cartons to an erected condition and delivering open and erected cartons to said conveyor with said attachment side of said cartons facing said conveying means, said conveying means including laterally spaced conveyor members adapted to engage and support said open and erected carton following a delivery thereto by said continuously rotating rotatable member and said suction mechanisms moving therewith, each said suction mechanism including carton positioning means supporting said suction means for movement, in response to the control of said suction mechanism provided by said carton manipulating means, into and out of a region between said laterally spaced conveyor members to facilitate and orienting of each of said erected carton in an upstanding relation above said suction mechanism as a release of said suction mechanism from said erected carton occurs leaving said erected carton supported on said laterally spaced conveyor members, said lateral spacing thereby facilitating a maintaining of said finite distance between said outlet opening and said conveyor members even when different height cartons are presented to said outlet opening and said laterally spaced conveyor members.

2. The carton delivery apparatus according to claim 1, wherein said plurality of said suction mechanisms on said rotatable member are equidistantly circumferentially spaced on said rotatable member.

3. The cartoon delivery apparatus according to claim 1, wherein said support means includes a plurality of support shafts mounted on said rotatable member for rotation therewith, said support shafts being parallel to said primary shaft, and each of said suction mechanisms being fixed to a respective one of said support shafts.

4. The carton delivery apparatus according to claim 3, wherein said carton manipulating means includes a fixedly oriented cam plate having means defining a cam track therein, and a plurality of cam followers for engaging said cam track, a plurality of further rotatable shafts mounted on said rotatable member, a plurality of sector gears, each said sector gear being connected to a respective one of said further rotatable shafts, each sector gear having a respective one of said cam followers thereon, said cam plate being disposed adjacent to the rotatable member, whereby the sector gear rotates relative to the rotatable member while said rotatable member rotates relative to said cam plate, said sector gear operatively engaging a gear fixedly mounted on said support shaft so that as said sector gear moves said support shaft will rotate.

5. The carton delivery apparatus according to claim 4, wherein said carton positioning means includes a crank arm secured to a respective said support shaft, wherein said crank arm has an arm thereon which has a straight part extending parallel to said support shaft and away from said rotatable member.

6. The carton delivery apparatus according to claim 5, wherein said carton positioning means further includes a generally L-shaped member having first and second legs generally perpendicular to each other, said first leg being fixedly connected at one end thereof to said straight part at a location spaced from said rotatable member and extending generally perpendicular to a longitudinal axis of said respective support shaft, said second leg being connected to the other end of said first leg and extending also generally perpendicular to said longitudinal axis of said support shaft.

7. The carton delivery apparatus according to claim 1, wherein said suction means includes at least one substantially cupshaped sucker.

8. The carton delivery apparatus according to claim 7, including a vacuum source connected to said sucker of said suction mechanism through passages formed in said suction mechanism, said rotatable member and said primary shaft.

9. The carton delivery apparatus according to claim 1, wherein said rotatable member has a plurality of gear teeth formed around the periphery thereof, said rotatable member being driven by a rotatably driven gear which operatively engages said gear teeth to thereby drive said rotatable member for rotation.

10. The carton delivery apparatus according to claim 1, including further suction means for subjecting a carton, which is held attracted to said rotatable member by said suction mechanism, to a preliminary erection by attractingly holding a surface opposite from that held attracted by said suction mechanism.

11. The carton delivery apparatus according to claim 1, including unfolding means for subjecting a carton, held attracted to said rotatable member by said suction mechanism, to a preliminary erection by an interference therewith during the movement of said suction mechanism.

* * * * *